US005573598A

United States Patent [19]

Koch

[11] Patent Number: 5,573,598

[45] Date of Patent: Nov. 12, 1996

[54] METHOD OF CLEANING PRESSING AND/OR CURING APPARATUS

[75] Inventor: Roger E. Koch, St. Charles, Ill.

[73] Assignee: Masonite Corporation, Chicago, Ill.

[21] Appl. No.: 398,913

[22] Filed: Mar. 6, 1995

[51] Int. Cl.[6] ..... B08B 7/04

[52] U.S. Cl. ..... 134/7; 134/6; 134/20; 134/42

[58] Field of Search ..... 134/6, 7, 42, 20

[56] References Cited

U.S. PATENT DOCUMENTS

| | | | |
|---|---|---|---|
| 2,571,986 | 10/1951 | Hallonquist | 18/47.5 |
| 2,599,092 | 6/1952 | Craig | 92/3 |
| 2,653,883 | 9/1953 | Thomas | 134/30 |
| 2,744,013 | 5/1956 | Dorland et al. | 92/21 |
| 2,775,170 | 12/1956 | Bustin et al. | 92/61 |
| 2,796,367 | 6/1957 | Brown | 134/6 |
| 2,843,509 | 7/1958 | Arden | 134/39 |
| 2,992,995 | 7/1961 | Arden | 252/152 |
| 3,305,499 | 2/1967 | Bevans | 260/17.3 |
| 3,549,485 | 12/1970 | Eckert | 162/152 |
| 3,617,427 | 11/1971 | LeBlanc | 161/133 |
| 3,927,235 | 12/1975 | Chow | 428/302 |
| 3,981,950 | 9/1976 | Pletzer et al. | 264/109 |
| 4,022,639 | 5/1977 | Ueki | 134/2 |
| 4,060,580 | 11/1977 | Pampel | 264/109 |
| 4,082,904 | 4/1978 | Bornstein | 428/528 |
| 4,110,397 | 8/1978 | Wooler | 264/109 |
| 4,175,148 | 11/1979 | Luck et al. | 428/171 |
| 4,228,202 | 10/1980 | Tjännberg | 427/212 |
| 4,238,438 | 12/1980 | Laughinghouse et al. | 264/119 |
| 4,283,450 | 8/1981 | Luck et al. | 428/171 |
| 4,305,989 | 12/1981 | Luck et al. | 428/171 |
| 4,379,808 | 4/1983 | Cole et al. | 428/438 |
| 4,423,173 | 12/1983 | Janiga | 524/14 |
| 4,479,912 | 10/1984 | Bullock | 264/23 |
| 4,514,255 | 4/1985 | Maxwell et al. | 162/9 |
| 4,514,532 | 4/1985 | Hsu et al. | 524/14 |
| 4,517,240 | 5/1985 | Tracton et al. | 428/326 |
| 4,692,292 | 9/1987 | Kollmeier et al. | 264/126 |
| 4,734,231 | 3/1988 | Morita et al. | 264/45.3 |
| 4,879,083 | 11/1989 | Knudson et al. | 264/122 |
| 4,915,766 | 4/1990 | Baxter | 156/335 |
| 4,933,015 | 6/1990 | White | 134/6 |
| 4,935,457 | 6/1990 | Metzner et al. | 524/14 |
| 4,944,823 | 7/1990 | Stofko | 156/283 |
| 5,030,292 | 7/1991 | Koike et al. | 134/6 |
| 5,055,247 | 10/1991 | Ueda et al. | 264/109 |
| 5,064,592 | 11/1991 | Ueda et al. | 264/112 |
| 5,262,006 | 11/1993 | Andersson et al. | 162/147 |
| 5,367,040 | 11/1994 | Teodorczyk | 528/137 |

OTHER PUBLICATIONS

Kirk–Othmer "Encyclopedia of Chemical Technology," vol. 21, 2nd Ed. 1970, pp. 601–620.

*Primary Examiner*—Jill Warden

*Attorney, Agent, or Firm*—Marshall, O'Toole, Gerstein, Murray & Borun

[57] ABSTRACT

A method of cleaning a pressing and/or curing apparatus includes providing a cleaning mat on the interior of the apparatus and subjecting the cleaning mat to elevated temperature and/or pressure. The cleaning mat is pre-treated with a cleaning composition which preferably includes sodium carbonate. The method obviates and/or reduces the need to disassemble a pressing apparatus (e.g., remove die sets) for periodic cleaning.

16 Claims, No Drawings

METHOD OF CLEANING PRESSING AND/OR CURING APPARATUS

BACKGROUND OF THE INVENTION

1. Field of the Invention

The invention relates generally to the manufacture of composite cellulosic materials. More particularly, the invention relates to methods for cleaning apparatus used in the consolidation of composite cellulosic materials.

2. Brief Description of Related Technology

Composite cellulosic materials can advantageously be used in the manufacture of many different products. Composite cellulosic materials can be molded to have various shapes and sizes and to have various design and structural features which may or may not have been available with products made from natural wood or other materials. Methods for producing manmade cellulosic composites are disclosed, for example, in U.S. Pat. No. 5,367,040 (Nov. 22, 1994) to Teodorczyk and U.S. Pat. No. 4,514,532 (Apr. 30, 1985) to Hsu et al. The disclosures of these patents are hereby incorporated herein by reference.

A variety of types of cellulosic (e.g., wood) composite materials exist, including flat or contoured boards of pressed cellulosic material and/or boards of bonded cellulosic sheets. Examples of types of useful man-made boards can be referred to by the following terms: (a) fiberboards, such as hardboard, softboard, and medium density fiberboard and (b) chipboards, such as particleboard and oriented strandboard. Composites of these boards (i.e., articles comprising two or more of these materials) can also be useful.

Many different methods of manufacturing these cellulosic composites are known in the art. Methods for manufacturing fiberboard include (a) wet felted/wet pressed or "wet" processes, (b) dry felted/dry pressed or "dry" processes, and (c) wet felted/dry pressed or "wet-dry" processes. Synthetic resins, such as phenolformaldehyde resins, are often used as binders in these processes.

Generally, in a wet process, cellulosic fillers are blended in a vessel with large amounts of water to form a slurry. Useful cellulosic materials include, for example, woody material that is subjected to fiberization to form wood fibers. The slurry preferably has sufficient water content to suspend a majority of the wood fibers. The slurry is deposited along with a binder material, such as resin binder, onto a water-pervious support member, such as a fine screen or a Fourdrinier wire, where much of the water is removed to leave a wet mat of cellulosic material having, for example, a moisture content of about 50 weight percent. The wet mat is then consolidated under heat and pressure to form the cellulosic composite.

A wet-dry forming process can also be used to produce cellulosic composite materials. Preferably, a wet-dry process begins by blending cellulosic or wood fiber material in a vessel with a large amount of water. This slurry is then blended with a binder material. The blend is then deposited onto a water-pervious support member, where a large percentage of the water is removed, thereby leaving a wet mat of cellulosic material having a water content of about 40 weight percent to about 60 weight percent, for example. This wet mat is then transferred to a zone where much of the remaining water is removed by evaporation to form a dried mat having a moisture content of less than about ten weight percent. The dried mat is then consolidated under heat and pressure to form the cellulosic composite.

In a dry-felted process, the cellulosic filler is generally conveyed in a gaseous stream or by mechanical means. Cellulosic fibers can be first coated with a binder material, for example in a blowline blending procedure. The resin-coated fibers can then be randomly formed into a dry mat by air blowing the fibers onto a support member. The dry mat is then consolidated under heat and pressure to form the cellulosic composite.

Processes such as those described above, for example, can be used to manufacture a product having any desired shape depending on the intended use of the product. As mentioned above, the mat which is formed by a felting process (such as one of the felting processes described above) is typically placed in a pressing apparatus. The pressing apparatus typically includes a pair of pressing dies, often referred to as a die set. The mat is subjected to elevated temperatures and pressures in the pressing apparatus, so as to cure the binder material and compress the mat into an integral consolidated structure.

One disadvantage of the above-described methods is that undesirable by-products of the pressing operation tend to build up on the surfaces of the die sets. Each of the above-described methods can result in the formation of such undesirable materials. These undesirable materials can be in the form of a film that contains carbon and other materials. Such a film is commonly referred to as a "carbon film" or "carbonaceous film." The carbon film is undesirable, for example, because it may interfere with the pressing operation and/or damage the final product. For example, when this build-up problem becomes severe, flakes of the carbon film can come off of the dies and be pressed onto or through the surface of the production mat which is being pressed. Such an occurrence can create a downgraded or unusable product. Such a film can also damage the die surfaces themselves.

In the past, because the carbon film is difficult to remove from the die surfaces, this problem has typically been overcome by removing the dies from the pressing apparatus for cleaning. The need to remove the dies from the pressing apparatus is generally undesirable due to the extra cost, complication, and time which is required for the operation. Such an operation can create a loss of production time of approximately six to eight hours. Other attempts to use in-press cleaning of dies, for example, those processes using caustic soda, sticky resins, water, or other chemicals can be dangerous and/or not effective.

Therefore, it is desirable to provide a method for satisfactorily cleaning die sets of pressing apparatus. It is also desirable provide an effective method for cleaning die sets without the need to remove the dies from the pressing apparatus. It is further desirable that such methods are not dangerous to the user and cannot cause damage to the products which are manufactured in the pressing apparatus.

SUMMARY OF THE INVENTION

It is an object of the invention to overcome one or more of the problems described above.

Accordingly, the invention provides a method for cleaning apparatus used in the production of composite materials that is efficient and effective and eliminates or reduces the problems described above.

The inventive method generally includes providing a cleaning mat which has been treated with a cleaning composition. The cleaning solution preferably includes sodium carbonate. The cleaning mat is then subjected to heat and/or pressure in a pressing or curing apparatus.

The invention preferably obviates and/or reduces the frequency of the need for any disassembly of the apparatus, as is usually required when cleaning the apparatus. The invention also preferably provides a safe, effective method for cleaning an apparatus used in the manufacture of composite articles.

Further objects and advantages of the invention will be apparent to those skilled in the art from the following detailed description, taken in conjunction with the appended claims.

DETAILED DESCRIPTION OF THE INVENTION

According to the inventive cleaning method, a cleaning mat is placed on the interior of a pressing and/or curing apparatus. A cleaning compound or composition (e.g., a cleaning solution) is provided on at least one surface of the cleaning mat. The cleaning mat is then subjected to elevated temperature and/or pressure in the apparatus, so as to remove undesirable materials from one or more surfaces of the apparatus.

The term "pressing and/or curing apparatus" as used herein refers to any suitable apparatus which can be used to convert a mat or mass of material into a solid, integral product. The inventive method is preferably used in a pressing apparatus which has the ability to both press and cure a mat of material, i.e., a "pressing apparatus." However, the present invention could be used with an apparatus which does not press, but only cures, a mat of material, i.e., a "curing apparatus."

The term "cleaning mat" is used herein to refer to an object which can be placed on the interior of the pressing apparatus. As described herein, the cleaning mat can be made of any desired material; however, the cleaning mat is preferably made of the same material(s) which are pressed and/or cured in the actual production steps.

The cleaning composition is highly preferably in the form of an aqueous cleaning solution, and such solution preferably includes aqueous sodium carbonate ($Na_2CO_3$). The cleaning solution preferably, but not necessarily, also includes a pre-press sealer. The cleaning composition is preferably applied to the cleaning mat in aqueous form in order to generate steam in the pressing apparatus, which aids in the removal of undesirable materials from the pressing apparatus. In addition, a solution increases the uniformity of coverage of the cleaning mat.

The cleaning solution is preferably applied to the cleaning mat at a rate in the range of about 10 wet grams per square foot of mat to about 40 wet grams per square foot of mat, and more preferably in the range of about 25 wet grams per square foot to about 40 wet grams per square foot. ("Wet grams" refers to the weight of solution.) The cleaning solution is preferably applied to an unpressed mat.

A preferred method for cleaning a pressing apparatus used in manufacturing a composite cellulosic article will now be described. However, there are many modifications and alternatives to the following example. The inventive method contemplates, for example, variations of treatment temperature, selection of materials, and sequence of the procedure.

The inventive method is preferably used in conjunction with a method for producing hardboard doorskins. However, the inventive method can be similarly used for cleaning pressing apparatus used in the production of the other cellulosic composites disclosed above. Further, although the invention is preferably utilized in conjunction with processes wherein materials are cured under both pressure and heat, the invention is also useful in conjunction with apparatus which does not cure materials under both pressure and heat.

According to the preferred method, a cleaning mat of cellulosic material is formed, for example according to one of the methods described above. Preferably, the cleaning mat is made of wood fiber or other cellulosic materials having a density in the range of about 12 to about 20 pounds per cubic foot. Cleaning mats which have sufficient stiffness to facilitate handling, such as an insulation type board, are preferred. One advantage of the inventive method is that the cleaning mat can be adapted from a production mat on the production line in which the apparatus is situated.

The inventive method is preferably used in conjunction with a dry pressing method, such as one of the dry methods described above. In wet pressing methods, the wet mat might dilute the cleaning solution to a point of ineffectiveness. Thus, where it is desired to clean a pressing apparatus in a wet press line, it generally would be advantageous to use a dry cleaning mat (e.g., a mat having a moisture content of less than about 30 weight percent).

According to the preferred process, a cleaning composition in the form of a cleaning solution having the following components is provided: about 3.0 weight percent sodium carbonate, about 11.6 weight percent Fibertite® I pre-press sealer, and about 85.4 weight percent water. After initially mixing such a cleaning solution, it is preferable to agitate or mix that solution after a period of time. Preferably, the formulation does not deviate more than plus or minus about 1 percent from the formulation listed above. For example, the cleaning solution can include about 2 to 4 weight percent sodium carbonate and about 10 to about 13 weight percent of a pre-press sealer or press release agent.

Fibertite® I pre-press sealer (manufactured by Lilly Industries, Inc. of Indianapolis, Ind.) is a preferred press release agent. The Fibertite® I sealer will preferably allow the cleaning mat to release from the die set of the pressing apparatus, while increasing the tendency of the "carbon film" to adhere to the cleaning mat. Agitation of the solution prior to application preferably insures the uniformity of the components of the solution. Over extended periods of time, the pre-press sealer may tend to settle to the bottom of the solution; however, the cleaning solution returns to a homogeneous state after mixing.

Other pre-press sealers and press release agents besides the Fiberrite® I product are known to those skilled in the art. Other press release agents known in the art include wax-based materials, silicones, various polymers, and Dow Corning 290 silicone emulsion (a paintable grade silicone emulsion manufactured by Dow Corning of Midland, Mich.). However, it has been found that Fibertite® I sealer provides the cleaning solution with the most effective cleaning ability.

The cleaning solution is preferably applied to all surfaces of the cleaning mat which come into contact with surfaces of the pressing apparatus, including the substantially entire face or front surface and the substantially entire back or rear surface of the mat. Because carbonaceous material buildup is not a serious problem on the back side of a board, the need to clean the pressing surfaces (e.g., a bottom die) which contact the back side of the board is not as crucial as cleaning the pressing surfaces (e.g., a top die) which contact the face of the board. Therefore, the cleaning solution is preferably applied to at least the substantially entire face or front surface of the cleaning mat (i.e., the surface of the cleaning mat which corresponds to the face or front surface of a production mat). In this way, the surfaces of the pressing apparatus which contact the face of the mat are assured of being cleaned.

A spray nozzle is preferably used to apply the cleaning solution on the surface of the cleaning mat. Other suitable techniques such as roll coating or flood and squeegee methods can also be used. These application methods preferably provide a substantially uniform application of the cleaning solution over the treated surface.

The cleaning solution can be applied to the mat at numerous points in the process. For example, in a wet felted process (such as the "wet" process described above), the cleaning solution is preferably applied after the final water removal stage. In a wet felted/dry pressed process (i.e., a "wet-dry" process), the cleaning solution is preferably applied after the final drying step. (For example, if there are two drying steps, the cleaning solution is preferably applied after the secondary drying step.) In a dry felted/dry pressed process (i.e., a "dry" process), the cleaning solution can be applied at any time prior to consolidation.

The cleaning mat is preferably wet when it enters the pressing apparatus. For example, if the inventive cleaning solution is added after the first drying step of a two-part drying system (or too far in front of the pressing apparatus), excessive drying could occur and reduce the efficiency of the cleaning solution.

The inventive method preferably provides a cleaning solution to a cleaning mat (as opposed to placing a cleaning solution on a production mat) because the cleaning solution will generally produce undesirable effects on the product. A consolidated cleaning mat may preferably have a higher density than a consolidated production mat and likely will have damaged surfaces from the carbonaceous materials in the press. Further, the higher moisture content resulting from a cleaning solution can cause blisters or other blemishes on the cleaning mat. Thus, once the cleaning mat is consolidated, it is typically discarded. For these reasons, it is generally not desirable to use the cleaning treatment as part of a continuous production process.

In order to clean the pressing apparatus, the cleaning mat which has been provided with the cleaning solution is subjected to heat and pressure in the pressing apparatus. Preferably, the combination of heat, pressure, and the cleaning solution will cause the carbon film to become (a) detached from the pressing surfaces and (b) associated with the cleaning mat.

With the exception of press time, a standard press cycle used by the manufacturer to produce production grade mats is preferably used to consolidate the cleaning mat. Such an operation will not require re-programming of the press apparatus control system or excessive system changes. An advantage of the inventive method is that the method is able to use processing conditions similar to normal production conditions, so that any required changes are minimized or obviated.

Generally, press temperatures are preferably in the range of about 400° F. to about 500° F. (about 204° C. to about 260° C.), and more preferably in the range of about 425° F. to about 470° F. (about 218° C. to about 261° C.). Pressures above 400 psig are preferred. However, press times and pressures are variable depending upon the processing materials and conditions.

With regard to press time, if the inventive method is used in conjunction with a pressing apparatus in a dry process line or a wet-dry process line, press times are preferably reduced from those times used to press production mats, in order to compensate for the elevated moisture content of the cleaning mat caused by an aqueous cleaning solution. In many circumstances, the time under full pressure is preferably about 30 seconds. Decompression times or periods (i.e., the time over which the full pressure is released) are preferably greater than the decompression times used when pressing production mats. For example, a decompression time in the range of about 20 to about 30 seconds will advantageously allow the steam and other gases in the press to release without a sudden blow-out of the mat. However, as stated above, the press times and pressures may need to be adjusted according to the particular product line in which the inventive method is being used.

Several press loads may be required to fully remove all undesirable built up materials, depending upon the extent of buildup of the materials. A press load refers to one complete pressing cycle that includes closing the press, increasing pressure, followed by opening the press over a decompression period to relieve the pressure. The required press load will typically range from one to about four loads.

Frequency of use of the inventive method varies depending upon the rate of buildup specific to particular processes, products, and manufacturers. Preferably, however, the inventive cleaning process is not required more frequently than once in about every four days of continuous use of the production line.

The inventive method can avoid or reduce the cleaning steps typically necessary to remove buildup on die sets. Further, testing has shown that the inventive method can remove a very large percent (e.g., 98 percent) of the "carbonaceous" buildup on the dies. Other formulations of die cleaning solutions, such as those using caustic soda or sticky resins, are generally less effective and more dangerous than the inventive cleaning method.

Although the inventive method can be useful for cleaning an apparatus which does not provide an increase in pressure on the interior thereof (e.g., a "curing apparatus"), the inventive method highly preferably uses both heat and pressure to displace the undesirable materials from the apparatus onto the cleaning mat.

The foregoing description is given for clearness of understanding only, and no unnecessary limitations should be understood therefrom, as modifications within the scope of the invention will be apparent to those skilled in the art.

I claim:

1. A method of cleaning undesirable by-products from a pressing apparatus and/or a curing apparatus used in producing composite cellulosic materials, said method comprising the steps of:

(a) forming a cleaning mat comprising cellulosic material, said mat having a face surface and a back surface and a moisture content of less than about 30 weight percent;

(b) placing said cleaning mat on at least one interior surface of said apparatus;

(c) applying a cleaning composition to at least one substantially entire surface of said cleaning mat that contacts said surface of said apparatus; and (d) subjecting the cleaning mat to at least one of elevated temperature and pressure in said apparatus to cause undesirable by-products to detach from said surface of said apparatus and become adhered to said cleaning mat.

2. The method of claim 1, wherein:

the cleaning mat comprises wood fiber having a density in a range of about 12 to about 20 pounds per cubic foot.

3. The method of claim 1, wherein:

said cleaning composition comprises an aqueous solution.

4. The method of claim 3, wherein:

said aqueous solution comprises sodium carbonate.

5. The method of claim 3, wherein:

said cleaning composition comprises an aqueous solution of: about 2 to about 4 weight percent sodium carbonate and about 10 to about 13 weight percent of a pre-press sealer or press release agent.

6. The method of claim 3, wherein:

said aqueous solution is applied to said cleaning mat at a rate in a range of about 10 grams per square foot of mat to about 40 grams per square foot of mat.

7. The method of claim 3, wherein:

said aqueous solution is applied to said cleaning mat at a rate in a range of about 25 wet grams per square foot of mat to about 40 wet grams per square foot of mat.

8. The method of claim 3, wherein:

said aqueous solution is applied to substantially all surfaces of said cleaning mat.

9. The method of claim 3, wherein:

said cleaning mat comprises wood fiber; and said aqueous solution is applied prior to placing said cleaning mat on said at least one interior surface.

10. The method of claim 1, wherein:

said cleaning composition comprises an aqueous solution of: about 3 weight percent sodium carbonate and about 11 to about 12 weight percent prepress sealer.

11. The method of claim 1, wherein:

said cleaning mat is subjected to elevated temperature and said elevated temperature is in a range of about 400° F. to about 500° F. (about 204° C. to about 260° C.).

12. The method of claim 1, wherein:

said cleaning mat is subjected to elevated temperature and said elevated temperature is in a range of about 425° F. to about 470° F. (about 218° C. to about 261° C.).

13. The method of claim 1, wherein:

said mat is subjected in step (d) to an elevated temperature and/or pressure for a time in a range of about 20 to about 40 seconds.

14. The method of claim 1, wherein a press cycle comprises subjecting said mat to at least one of an elevated temperature and pressure followed by substantially reducing said at least one of an elevated temperature and pressure and wherein step (d) comprises at least one press cycle, said method further comprising the step of:

(e) subjecting said cleaning mat after step (d) to at least one additional press cycle.

15. The method of claim 1, further comprising:

discarding said cleaning mat.

16. A method of cleaning undesirable by-products from a pressing apparatus used in producing composite cellulosic materials, said method comprising the steps of:

(a) forming a cleaning mat comprising cellulosic material, said mat having a face surface and a back surface and a moisture content of less than about 30 weight percent;

(b) placing said cleaning mat on at least one interior surface of said apparatus;

(c) applying a cleaning composition to at least one substantially entire face or back surface of said cleaning mat at rate in a range of about 10 wet grams per square foot of mat to about 40 wet grams per square foot of mat, said cleaning composition comprising an aqueous solution of:

(a) about 2 to about 4 weight percent sodium carbonate and (b) about 10 to about 13 weight percent of a pre-press sealer or press release agent; and (d) consolidating the cleaning mat in said apparatus under (i) elevated temperature of at least about 400° F. and (ii) and elevated pressure to cause undesirable by-products to detach from said surface of said apparatus and become adhered to said cleaning mat.

* * * * *